United States Patent [19]

McKee

[11] 4,128,234

[45] Dec. 5, 1978

[54] CABINET INSTALLATION TOOL

[76] Inventor: Harry A. McKee, 6851 Roswell Rd., Atlanta, Ga. 30328

[21] Appl. No.: 841,649

[22] Filed: Oct. 13, 1977

[51] Int. Cl.[2] ..... B25B 11/02

[52] U.S. Cl. ..... 269/97; 269/321 S

[58] Field of Search ..... 269/321 S, 71, 73, 76, 269/45, 97; 214/1 S, 1 SW

[56] References Cited

U.S. PATENT DOCUMENTS

| | | | |
|---|---|---|---|
| 1,763,634 | 6/1930 | Agobian | 269/97 |
| 3,037,767 | 6/1962 | Haynes et al. | 269/97 |
| 3,595,556 | 7/1971 | Schonaver | 269/71 |

*Primary Examiner*—Robert C. Watson

*Attorney, Agent, or Firm*—Jones, Thomas & Askew

[57] ABSTRACT

A cabinet installation tool includes a frame of adjustable depth to be engagingly mounted across the top of a base cabinet, a vertical support member carried by the frame, a horizontal plate mounted atop the vertical support member for engaging the bottom of a wall cabinet, and means for adjusting the height of the vertical support member, so that by using one or more of the tools a single person may mount a wall cabinet following installation of the base cabinet.

5 Claims, 7 Drawing Figures

CABINET INSTALLATION TOOL

BACKGROUND OF THE INVENTION

This invention relates to built-in cabinets and more particularly to a tool for the installation of wall cabinets.

Under the current practice for installing kitchen and vanity-type cabinets, where both base cabinets and wall cabinets are to be installed, the base cabinets are first placed in proper position on the floor, leveled, and then secured against the wall. One person can generally accomplish this task. However, when the upper wall cabinets are installed three persons are generally required, two to hold the wall cabinet in position and a third person to check the height and level adjustment of the wall cabinet and then to secure the cabinet to the wall or soffitt structure. Thus, it has been difficult or sometimes impossible for a single individual to properly align and install wall cabinets.

SUMMARY OF THE INVENTION

Briefly described, a cabinet installation tool according to the present invention comprises a frame engagingly mounted across the top of a base cabinet, means for engaging the bottom of a wall cabinet, and support means connecting the frame to the wall cabinet engaging means for supporting the wall cabinet at a preselected height above the base cabinet, whereby the wall cabinet may be mounted by a single person.

A tool according to the present invention may include means for adjusting the depth of the frame to accommodate base cabinets of varying depths and means for slidably adjusting the height of the wall cabinet engaging means. It will thus be seen that by using one or more of the tools described herein, a single person may properly align and install a wall cabinet by supporting the wall cabinet on a tool or tools, leveling the wall cabinet, securing the wall cabinet to the wall, and then releasing the thumbscrews and removing the tool or tools for use in installing additional wall cabinets in other locations.

DESCRIPTION OF THE PREFERRED EMBODIMENTS

Figure 1:
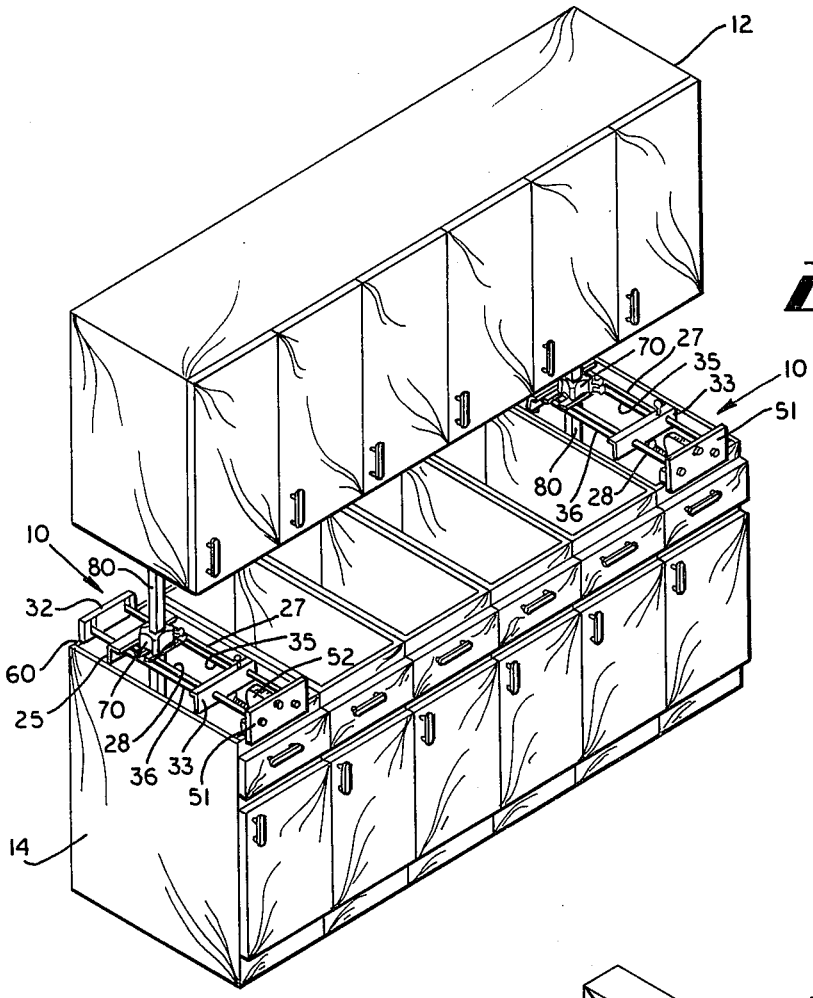
FIG. 1 is a perspective view of a pair of cabinet installation tools according to the present invention in operative engagement with base and wall cabinets.

Referring in more detail to the drawing, in which like numerals represent like parts throughout the several figures, FIG. 1 shows a pair of cabinet installation tools 10 engagingly mounted on a base cabinet 14 and supporting a wall cabinet 12. As shown in FIGS. 1–4, a cabinet installation tool according to the present invention includes a horizontal frame 20 and a vertical support member 21. The frame 20 includes a pair of subframes 23 and 30. Subframe 23 is a rectangle comprising parallel rods 27 and 28 fixed at their ends to L-shaped flanges 24 and 25. The L-shaped flanges 24 and 25 are oriented so that one leg of the "L" is perpendicular to the rods 27 and 28 and so that the other leg of the "L" extends horizontally over the rods. Similarly, a second subframe 30 comprises parallel rods 35 and 36 fixed in the same manner to L-shaped flanges 32 and 33.

The subframes 23 and 30 are slidably interconnected in the same horizontal plane, as shown in FIGS. 1–3 and 5. Rods 27 and 28 pass through holes 40 and 41, respectively, in L-shaped flange 33, and rods 35 and 36 pass through holes 42 and 43, respectively, in L-shaped flange 25. A set screw 44 is threaded through the horizontal leg of the L-shaped member 33 directly above the rod 27 so that the relative position of the two subframes may be fixed at any desired position by tightening the set screw 44.

Figure 6:
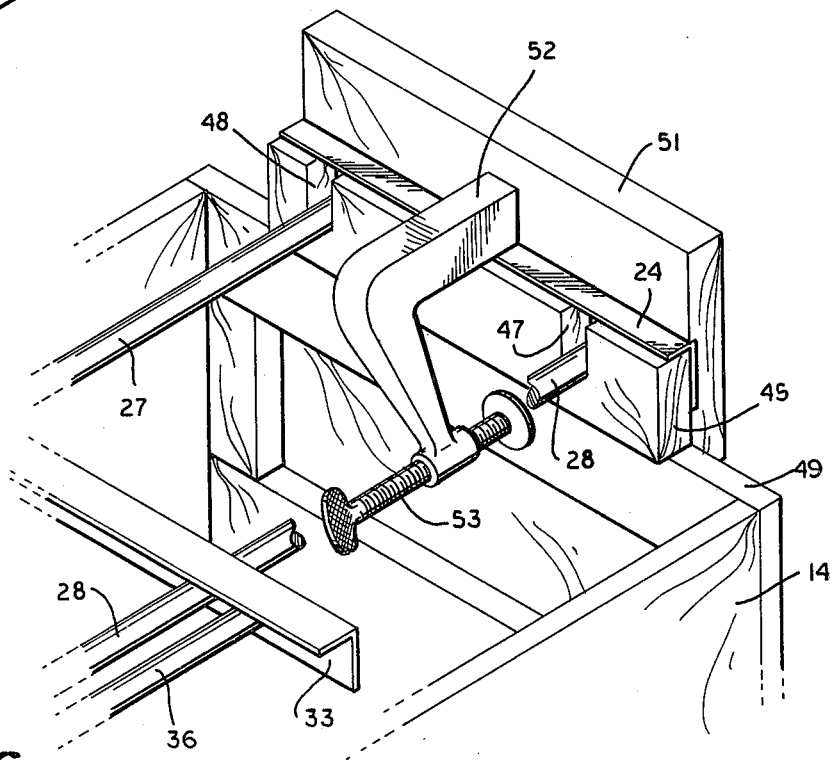
FIG. 6 is a pictorial view of the front portion of the frame member in engagement with the front wall of a base cabinet.
Figure 2:
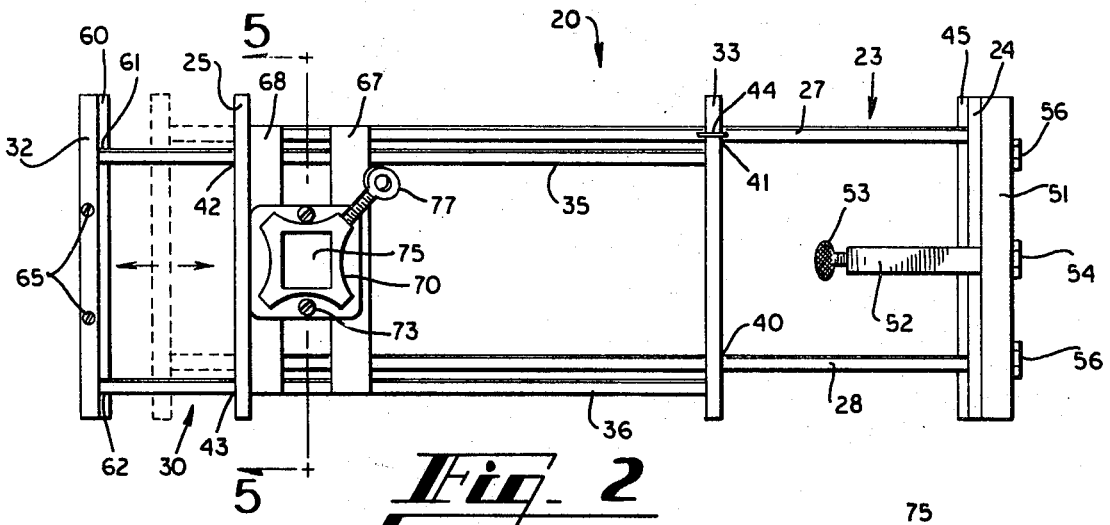
FIG. 2 is a top plan view of the frame portion of a cabinet installation tool according to the present invention.
Figure 5:
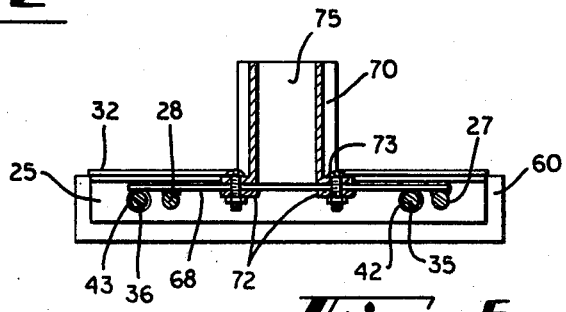
FIG. 5 is a vertical cross sectional view taken along line 5—5 of FIG. 2.
Figure 4:
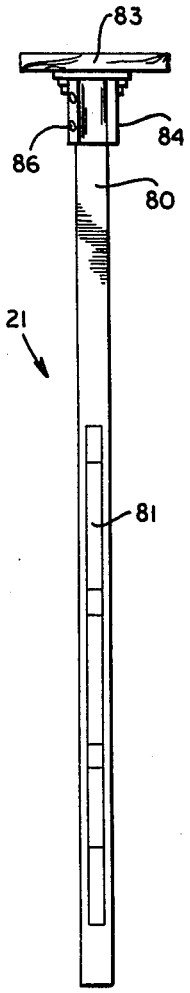
FIG. 4 is a front plan view of a vertical support member of a tool according to the present invention.
Figure 3:
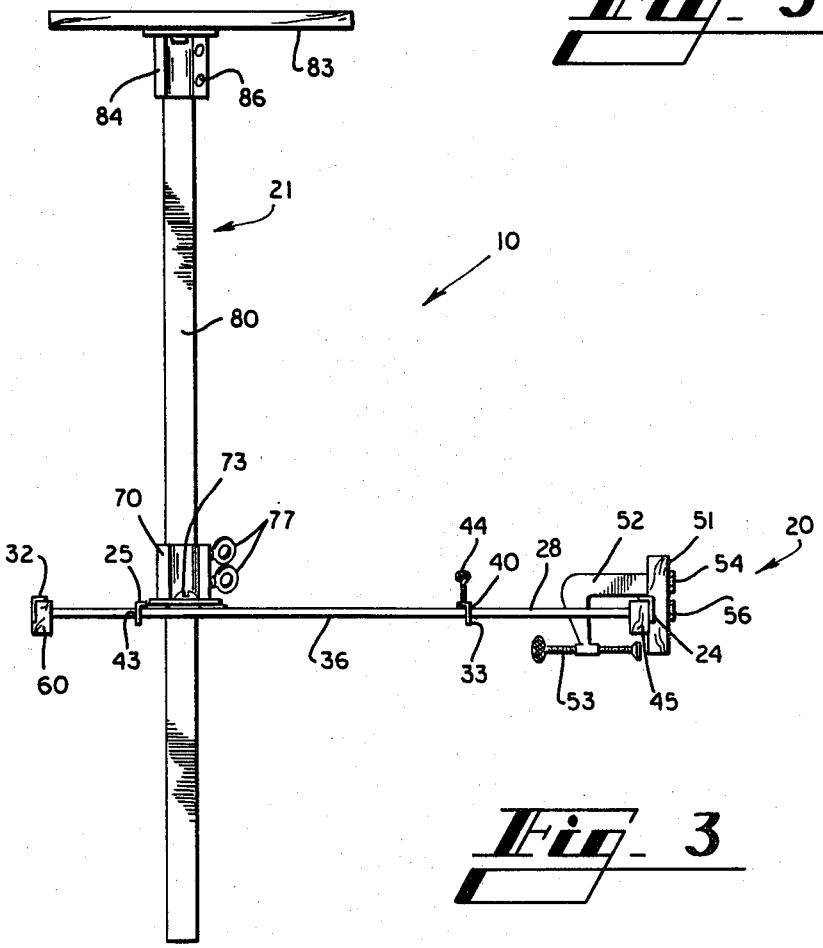
FIG. 3 is a side plan view of an entire cabinet installation tool according to the present invention.

A rail 45, preferably comprising wood, is snugly fitted against the legs of the L-shaped flange 24, as shown in FIGS. 3 and 6. Slots 47 and 48 are provided in the rail 45 to accommodate rods 27 and 28. The rail 45 provides a surface for supporting the frame 20 on the front wall 49 of a base cabinet 14. A vertical plate 51 extending upwardly and downwardly beyond the rail 45 is fixed by any suitable means, such as bolts 56, to the rail 45 and the L-shaped flange 24 perpendicular to rods 27 and 28. An L-shaped clamp support member 52 is fixed to the vertical plate 51 above the rail 45 and extends below the rail 45 between the rods 27 and 28. The clamp support member 52 supports at its lowermost extent a thumb screw clamp 53 which may be screwed against the front wall 49 of the base cabinet 14 to clamp vertical plate 51 against the wall 49.

At the opposite end of the frame 20, a similar rail 60 is fitted into L-shaped flange 32. Slots 61 and 62 accommodate rods 35 and 36 of subframe 30 and the rail 60 is attached to flange 32 by screws 65. The rail 60 provides an appropriate surface for resting upon the back wall of the base cabinet 14.

Mounted across rods 35 and 36 of subframe 30 are a pair of parallel plates 67 and 68. The plates 67 and 68 are welded to rods 35 and 36 but move freely over rods 27 and 28. Another pair of parallel plates 72 are welded between plates 67 and 68 inside of rods 35 and 28. To the plates 72 is bolted by bolt 73 a socket member 70 which includes a square vertical opening 75 therethrough. A pair of set screws 77 are provided through the vertical wall of socket member 70 so that the vertical support member 21 passing through the opening 75 may be secured as described below. The position of plates 67 and 68 on rods 35 and 36 limits the relative sliding motion of the subframes 23 and 30, in that L-shaped flange 25 may travel from rail 60 to plate 68. Therefore the position of plates 67 and 68 is preferably selected so that when the frame 20 is fully extended and flange 25 is adjacent plate 68, the frame 20 has a length which is equal to the standard depth of a kitchen base cabinet. The lengths of the subframes 23 and 30 are preferably selected so that when the length of frame 20 is fully contracted, and the flange 25 is adjacent the rail 60, the length of frame 20 will be equal to the depth of a standard vanity base cabinet.

Since a standard kitchen base cabinet is 24 inches deep and a standard vanity base cabinet is 21 inches deep, in the preferred embodiment of the invention the frame when fully contracted is 21 inches long and the plate 68 is mounted 3 inches from the rail 60. The socket member 70 is preferably mounted with its center 6 inches from the end of the subframe 30 so that the vertical support member 21 will be centered with respect to a standard 12 inch depth wall cabinet.

Figure 7:
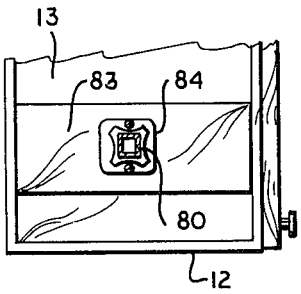
FIG. 7 is a bottom view of a vertical support member according to the present invention in engagement with the bottom of a wall cabinet.

The vertical support member 21 comprises a square shaft 80 which is of a cross-sectional size to be matingly received by the opening 75 in the socket member 70. A horizontal wall cabinet support plate 83 is perpendicularly attached to shaft 80 at one of the ends of the shaft 80. The connection between plate 83 and shaft 80 may be made by any suitable means, such as a bracket 84 which slidably receives shaft 80 and includes set screws 86 for securing shaft 80 within bracket 84. The wall cabinet support plate 83 preferably has a rectangular shape and has a length approximately equal to the depth of the cavity 13 located in the underside of the standard wall cabinet 12, as shown in FIG. 7.

In using the present invention to install a wall cabinet, one or two cabinet installation tools according to the present invention may be utilized depending on the width of the wall cabinet to be installed. The frame 20 is slidably adjusted and fixed by tightening set screw 44 at a length which allows rails 45 and 60 to rest upon the front and back walls of the base cabinet. When the frame is resting on the base cabinet, the thumb screw clamp 53 is tightened to hold the vertical plate 51 against the front wall 49 of the base cabinet, thereby securing the frame 20 in position on the base cabinet.

The vertical support member 21 is then placed in proper position by inserting vertical shaft 80 downwardly through the opening 75 in the socket member 70 of the frame 20. A scale 81 on the face of the vertical shaft 80 allows easy vertical adjustment of the vertical support member 21 at the proper height for various wall cabinets. When the proper height of vertical support member 21 has been selected, it is secured within the socket member 70 by tightening set screws 77. If the wall cabinet is too wide to be supported by a single cabinet installation tool, a second tool is placed into position in the same manner. A single person may then lift the wall cabinets and set them onto the wall cabinet support plates 83 which will support the wall cabinet with stability and without assistance. The same person is therefore free to attach the wall cabinet to the wall of the room in the usual manner.

When using tool 10 to install wall cabinets above base cabinets with drawers, the drawer of the base cabinet is simply pulled out slightly whenever necessary to permit shaft 80 to extend downwardly into the base cabinet. However, socket 70 could be made more elongated so that its set screws 77 are located at a higher position, and shaft 80 could then be shortened so that it would not need to extend downwardly into the base cabinet. In this case socket 70 could either be detachably mounted to bolts 73 or hinged (not shown) at its base to plate 67 so that it could be folded forward, to permit compact packaging of tool 10.

While this invention has been described in detail with particular reference to a preferred embodiment thereof, it will be understood that variations and modifications can be effected within the spirit and scope of the invention as described hereinbefore and as defined in the appended claims.

What is claimed is:

1. A tool for mounting cabinets in spaced relationship over base cabinets comprising:

an adjustable frame for mounting across the top of a base cabinet;

said frame including first rail means for engaging the vertical rear wall of a base cabinet and second rail means for engaging the vertical front wall of a base cabinet, means for adjustably moving said first rail means and said second rail means toward and away from each other so that said adjustable frame fits onto base cabinets of varying thicknesses, and means for fixedly attaching said adjustable frame to the base cabinet, vertical support means mounted on said frame for supporting an upper cabinet at a preselected height above the base cabinet, said vertical support means comprising socket means mounted on said adjustable frame, a support shaft received in said socket means and normally extending vertically above the base cabinet, and means for retaining said support shaft at various positions along its length with respect to said socket means whereby the tool is mounted on a base cabinet and an upper cabinet is supported above the base cabinet by the upper end portion of said support shaft.

2. The tool of claim 1 and further including a horizontal plate rigidly mounted on the upper end of said support shaft for supporting the upper cabinet over the base cabinet without other means of support.

3. An apparatus for mounting wall cabinets comprising a pair of tools, each of said tools including:

a rectangular frame including a back rail for resting on the upper edge of the back wall of a base cabinet; a front rail for resting on the upper edge of the front wall of said base cabinet; a vertical plate fixed to said front rail and extending downwardly adjacent the front wall of said base frame; means for clamping said plate to said front wall of said base cabinet; a pair of side rails connecting said front rail to said back rail; means for adjusting the length of said side rails; and a sleeve mounted vertically between said side rails;

a vertical support member slidably received by said sleeve;

means associated with said sleeve for retaining said support member at any selected position with respect to said sleeve; and a horizontal plate for engaging the bottom of a wall cabinet attached to the upper end of said vertical support member;

whereby said tools may be positioned adjacent opposite ends of said wall cabinet to provide stable support for said wall cabinet prior to the fixing of said wall cabinet to a wall.

4. Apparatus of claim 3 and wherein said vertical support member includes markings thereon at predetermined positions therealong which correspond to various heights of wall cabinets which are to be positioned with their upper surfaces a predetermined distance over the base cabinets, whereby said vertical support member is positioned in the sleeve with a marking located adjacent the sleeve and the apparatus is placed on a base cabinet and supports a wall cabinet of a height corresponding to the marking with its upper surface in alignment with other wall cabinets similarly installed over the base cabinet.

5. An apparatus for mounting wall cabinets comprising:

a frame including a back rail for resting on the upper edge of the back wall of a base cabinet; a front rail for resting on the upper edge of the front wall of the base cabinet; means for fixedly attaching said front rail to the front wall of the base cabinet; means for adjusting the distance between said front rail and said back rail, a sleeve member supported on said frame and normally oriented with its axial opening extending vertically, said sleeve member mounted between said front rail and said back rail, a vertical support member slidably received by said sleeve;

means for retaining said support member at various selected positions along its length with respect to said sleeve member; and a plate for engaging the bottom of a wall cabinet attached to the upper end portion of said vertical support member;

whereby said tool is positionable on a base cabinet to provide stable support for a wall cabinet prior to the fixing of the wall cabinet to a wall or the like.

* * * * *